US010309154B2

(12) United States Patent
Horn et al.

(10) Patent No.: US 10,309,154 B2
(45) Date of Patent: Jun. 4, 2019

(54) HEIGHT ACTUATED SELF-ACTIVATING SAFETY GATE

(71) Applicant: Toyota Motor Engineering & Manufacturing North America, Inc., Erlanger, KY (US)

(72) Inventors: Michael Horn, Kitchener (CA); Steven Yoell, Kitchener (CA); Dale Lukas, Paris (CA); Tsiuming Chu, Cambridge (CA)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 58 days.

(21) Appl. No.: 15/609,614

(22) Filed: May 31, 2017

(65) Prior Publication Data

US 2018/0347275 A1 Dec. 6, 2018

(51) Int. Cl.
*E06B 11/04* (2006.01)
*E06B 11/02* (2006.01)
(Continued)

(52) U.S. Cl.
CPC ..... *E06B 11/045* (2013.01); *B66F 17/006* (2013.01); *E04G 5/141* (2013.01);
(Continued)

(58) Field of Classification Search
CPC .... E06B 11/045; E06B 11/022; E06B 11/023; E06B 11/025; E06B 2009/002; E06B 2009/583; E06B 2009/785; E06B 9/78; E06B 3/92; E06B 3/921; B66F 17/006; E04G 5/141; E04G 3/28; E04G 2003/286; E05F 1/16; E05F 1/002; E05F 1/08; E05F 15/70; E05F 15/72; E05F 15/73; E05F 15/75; E05Y 2900/40
(Continued)

(56) References Cited

U.S. PATENT DOCUMENTS 2,191,643 A * 2/1940 Deckard ..... E21B 19/14 182/114
4,121,695 A * 10/1978 Carpenter ..... B60P 1/4421 414/539
(Continued)

*Primary Examiner* — Katherine W Mitchell
*Assistant Examiner* — Shiref M Mekhaeil
(74) *Attorney, Agent, or Firm* — Christopher G. Darrow; Darrow Mustafa PC

(57) ABSTRACT

Embodiments described herein relate to a self-extending/retracting gate for a platform. In one embodiment, safety gate includes a housing that extends laterally from a back support attached to the platform. The gate includes a sliding member that is operable to retract at least partially into the housing toward the back support to substantially conceal the sliding member within the housing and provide an opening beyond the housing for users to access the platform and to extend from an opening of the housing away from the back support to block access to the platform while the housing supports the sliding member. The gate includes a gate movement assembly within the housing between a rear portion of the sliding member and the back support. The gate movement assembly is operable to cause the sliding member to extend from the housing and retract into the housing according to a height of the platform.

20 Claims, 7 Drawing Sheets

(51) Int. Cl.

| | |
|---|---|
| ***E05F 1/16*** | (2006.01) |
| ***E04G 5/14*** | (2006.01) |
| ***B66F 17/00*** | (2006.01) |
| *E06B 9/00* | (2006.01) |
| *E04G 3/28* | (2006.01) |

(52) U.S. Cl.
CPC ..... *E05F 1/16* (2013.01); *E06B 11/022* (2013.01); *E04G 3/28* (2013.01); *E04G 2003/286* (2013.01); *E05Y 2900/40* (2013.01); *E06B 2009/002* (2013.01)

(58) Field of Classification Search
USPC ..... 49/49, 263, 274; 182/113
See application file for complete search history.

(56) References Cited

U.S. PATENT DOCUMENTS 4,185,716 A * 1/1980 Rinehart ..... B66F 11/044 182/113
4,488,326 A 12/1984 Cherry
4,984,955 A * 1/1991 McCullough ..... B66B 9/00 187/243
5,154,569 A * 10/1992 Eryou ..... A61G 3/063 14/71.3
5,273,132 A 12/1993 Sasaki et al.
5,313,739 A * 5/1994 Nelson ..... E05F 1/16 16/72
5,507,237 A * 4/1996 Barrow ..... B65D 19/08 108/53.1
5,803,204 A 9/1998 White et al.
6,182,798 B1 * 2/2001 Brady ..... B66B 9/0853 187/200
6,471,004 B2 10/2002 Stringer et al.
6,792,716 B1 * 9/2004 Luster ..... E01F 13/06 49/387
7,128,186 B2 * 10/2006 Ganiere ..... B64F 1/3055 182/63.1
7,356,966 B2 * 4/2008 Burke ..... B61L 29/04 49/49
7,384,017 B1 * 6/2008 Burke ..... B61L 29/04 246/125
7,533,494 B2 * 5/2009 Burke ..... B61L 29/22 49/49
7,721,850 B2 * 5/2010 Coble ..... B66B 9/0853 187/200
8,079,447 B2 * 12/2011 Zuercher ..... B66B 9/0853 187/200
8,176,677 B1 5/2012 Blackmon, III
8,257,008 B2 * 9/2012 Ellingson ..... B66F 9/127 182/14
8,534,422 B2 * 9/2013 Solhjem ..... B66F 11/04 182/141
8,651,236 B2 2/2014 Bowden
8,651,237 B2 * 2/2014 Pulliam ..... E02F 3/962 182/141
9,091,113 B2 7/2015 Pilgrim et al.
9,216,841 B1 * 12/2015 Ness ..... B65D 19/06
9,487,224 B1 * 11/2016 Pless ..... B61L 29/04
2008/0038055 A1 * 2/2008 Jankovsky ..... E01F 13/048 404/6
2009/0096231 A1 * 4/2009 Burlingame ..... B66F 11/04 294/68.3
2009/0217591 A1 * 9/2009 LaCook ..... E05D 11/06 49/50
2010/0108446 A1 * 5/2010 Griffin ..... B66B 9/00 187/261
2011/0100287 A1 * 5/2011 Povich ..... B63B 17/04 114/364
2011/0302844 A1 * 12/2011 Morey ..... E05D 15/16 49/360
2016/0097208 A1 * 4/2016 Stover ..... E06B 11/00 256/73
2016/0115006 A1 * 4/2016 Presti ..... B66F 11/042 182/19
2018/0112413 A1 * 4/2018 Palasek ..... E04D 13/0335

* cited by examiner

HEIGHT ACTUATED SELF-ACTIVATING SAFETY GATE

TECHNICAL FIELD

The subject matter described herein relates in general to automated safety equipment and, more particularly, to a height actuated safety gate that automatically extends and retracts according to a height of a lift.

BACKGROUND

Safety equipment can encompass a wide array of different devices. For example, different environments such as manufacturing facilities can include many different devices for electrical safety, fire safety, fall prevention, and so on. As one example, fall prevention equipment may include harnesses and tethers, safety railings, safety gates, and so on. However, many of these devices can be cumbersome and/or represent further difficulties. For example, some safety gates can have difficulties with pinch hazards from moving parts that engage the gates (e.g., swinging gates with a pivot point). In further examples, a gate swing arm and a work piece (e.g., manufacturing part) on a conveyor can form a pinch point when a manlift on which the gate is incorporated is in a lowered position. Moreover, the safety gates and other safety equipment can go unused when a worker is to remember that the particular device should be engaged before commencing work. Consequently, existing safety equipment, while useful in many respects, may still encounter difficulties.

SUMMARY

In one embodiment, a self-extending/retracting safety gate is disclosed. The disclosed safety gate is not, for example, dependent on the use of direct manipulation by a worker and, thus, can extend and retract when needed without manual manipulation. For example, in one aspect, the safety gate is implemented on a device that raises vertically from a floor. As such, in one embodiment, the safety gate is retracted providing access to a platform when in a lowered position on the floor. However, upon being raised above the floor, a gate movement assembly provided with the safety gate extends the safety gate to obstruct or otherwise close off an ingress/egress opening onto the platform. Thus, as the platform is raised, the safety gate provides automated safety by self-extending across the opening and providing for fall prevention of an operator.

In one embodiment, a safety gate for preventing falls from a platform is disclosed. The safety gate includes a housing that extends laterally from a back support attached to the platform. The housing is hollow. The safety includes a sliding member that is operable to (i) retract at least partially into the housing toward the back support to substantially conceal the sliding member within the housing and provide an opening beyond the housing for users to access the platform and to (ii) extend from an opening of the housing away from the back support to block access to the platform through the opening. The safety gate includes a gate movement assembly included at least partially within the housing between a rear portion of the sliding member and the back support, wherein the gate movement assembly is operable to cause the sliding member to extend from the housing and retract into the housing according to a height of the platform above a surface from which the platform raises.

In one embodiment, a gate connected to a platform is disclosed. The gate includes a housing that extends laterally from a back support attached to the platform, wherein the housing is hollow. The gate includes a sliding member that is operable to (i) retract at least partially into the housing toward the back support to substantially conceal the sliding member within the housing and provide an opening beyond the housing for users to access the platform and to (ii) extend from an opening of the housing away from the back support to block access to the platform through the opening. The gate includes a gate movement assembly included at least partially within the housing between a rear portion of the sliding member and the back support. The gate movement assembly is operable to cause the sliding member to extend from the housing and retract into the housing according to a height of the platform above a surface from which the platform raises. The gate movement assembly includes a connecting member attached to the sliding member at a first end and attached to an attachment point at a second end. The connecting member exerts a retracting force on the sliding member toward the back support when the platform is lowered toward the surface. The retracting force exerted by the connecting member is decreased as the platform is raised above the surface thereby permitting an extending force exerted by the gate movement assembly to extend the sliding member from the housing.

In one embodiment, a manlift is disclosed. The manlift includes a platform with railings connected thereto on at least three sides of the platform, the railings extending perpendicular from the platform to a railing height. The manlift includes a gate to selectively obstruct a side opening in the railings when the platform is raised above a floor surface and to retract to provide access through the side opening when the platform is lowered onto the floor surface, the gate comprising. The gate includes a housing that extends laterally from a back support attached to at least one of the railings. The housing is hollow. The gate includes a sliding member that is operable to retract at least partially into the housing toward the back support to substantially conceal the sliding member within the housing and to extend from the housing away from the back support to block access to the side opening of the platform while the housing supports the sliding member. The gate includes a gate movement assembly included at least partially within the housing between a rear portion of the sliding member and the back support. The gate movement assembly is operable to cause the sliding member to extend from the housing and retract into the housing according to a height of the platform above the floor surface from which the platform raises.

BRIEF DESCRIPTION OF THE DRAWINGS

The accompanying drawings, which are incorporated in and constitute a part of the specification, illustrate various systems, methods, and other embodiments of the disclosure. It will be appreciated that the illustrated element boundaries (e.g., boxes, groups of boxes, or other shapes) in the figures represent one embodiment of the boundaries. In some embodiments, one element may be designed as multiple elements or multiple elements may be designed as one element. In some embodiments, an element shown as an internal component of another element may be implemented as an external component and vice versa. Furthermore, elements may not be drawn to scale.

DETAILED DESCRIPTION

Systems, methods and other embodiments associated with a self-extending/retracting safety gate are disclosed. As mentioned previously, equipment operators and/or other workers may not use safety equipment when additional effort is needed to activate or otherwise implement use of the safety equipment. For example, when a manual gate needs closed a worker may leave the gate open because of forgetting to close the gate, an inability due to other tasks, and so on. Moreover, additional hazards can exist with some safety gates such as pinch hazards from pivots points where a gate swings open and shut.

Therefore, in one embodiment, a self-extending/retracting safety gate is provided. The self-extending/retracting safety gate is not dependent on direct manipulation by a worker and, thus, can extend and retract when needed without manual intervention. For example, in one aspect, the safety gate is implemented on a man-lift or another device that raises vertically from a floor. As such, in one embodiment, the safety gate is retracted providing access to the man-lift when the man-lift is in a lowered position on the floor. However, as the man-lift is raised above the floor, a gate movement assembly provided with the safety gate extends the safety gate to obstruct or otherwise close off an ingress/egress opening onto the man-lift. Thus, as the man-lift is raised, the safety gate provides automated safety by self-extending across the opening and providing for fall prevention of an operator.

In a similar, manner as the man-lift is lowered, the gate movement assembly is provided in such a configuration so as to, for example, automatically retract away from the ingress/egress opening. Consequently, the operation of the safety gate is automated according to a height of the man-lift, thereby removing interactions by a worker/operator. Additionally, in one embodiment, a particular configuration of the safety gate and sub-assemblies of the safety gate are implemented using mechanical means so that operation of the safety gate is improved to avoid electronic components and other complex mechanisms that can be prone to failure.

Figure 1:
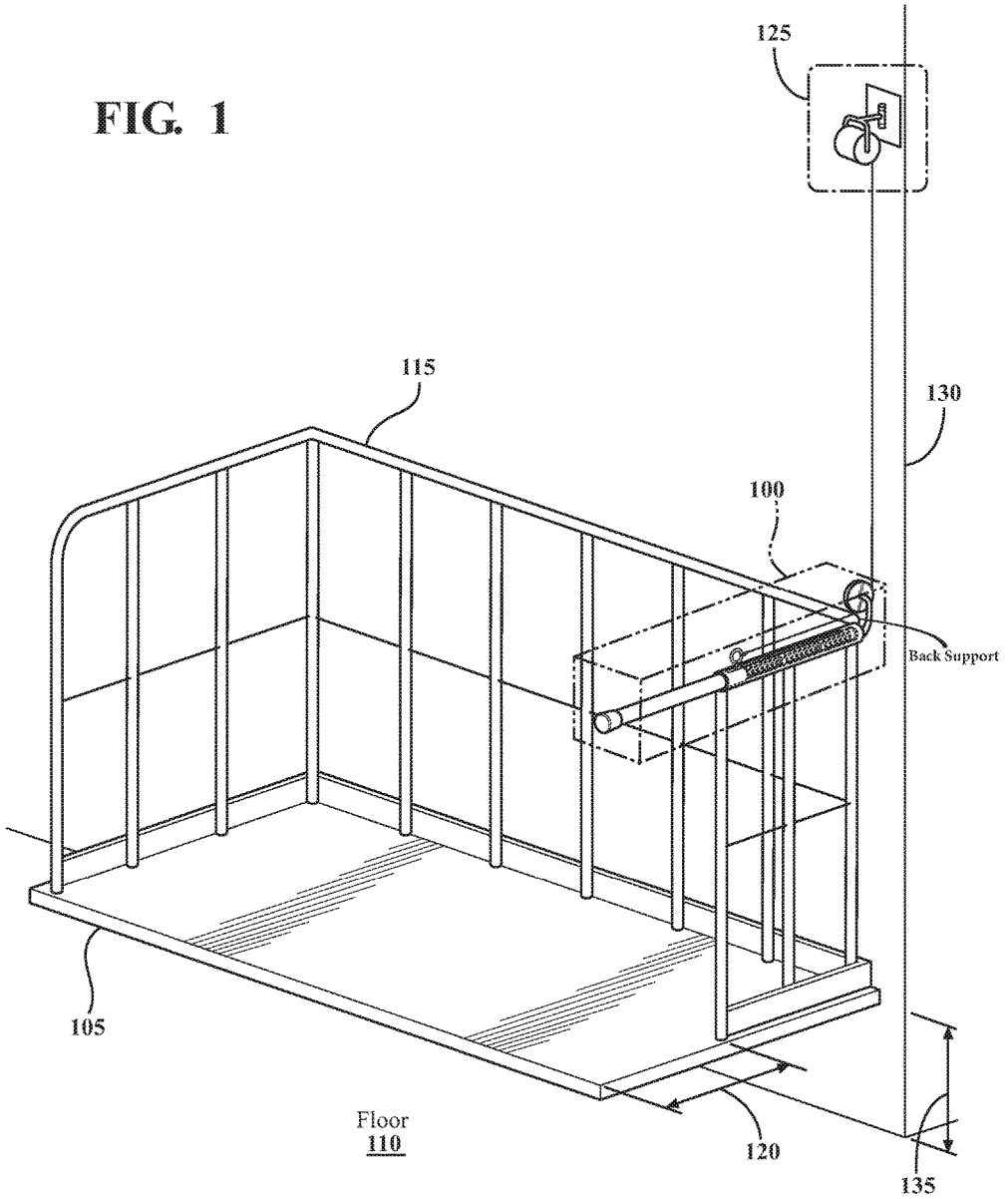
FIG. 1 illustrates an isometric view of one embodiment of a platform with a safety gate.

Referring to FIG. 1, one embodiment of a safety gate 100 is illustrated. As shown in FIG. 1, the safety gate 100 is illustrated in combination with a platform 105. The platform 105 is, for example, a sub-structure of a lift, such as man-lift, or another device that functions to raise and lower workers, cargo, and so on from a floor 110. Moreover, the platform 105, in one embodiment, includes railings extending up in a perpendicular direction from the platform 105 and around a perimeter of the platform 105. For various implementations, the railings 115 can be implemented with different configurations, such as with additional cross-members, additional supports or spindles, open sides of the platform 105, as a solid side-panel, and so on.

In either case, the railings 115, in one embodiment, define an ingress/egress opening 120 through which a worker/operator can gain access to the platform 105 when the platform 105 is lowered to the floor 110. Additionally, the safety gate 100 can be attached to the railings 115 at one side of the opening 120, as shown. Thus, the safety gate 100 can be integrated as part of the railing or added onto the railing 115.

As further explanation of how the safety gate 100 functions, a connecting member (e.g., a cable) of the safety gate is connected to an attachment point 125 on a wall 130 or other fixed structure. It should be noted that while the attachment point 125 is illustrated as being fixed to the wall 130 behind the platform 105, in general, the connecting member of the safety gate 100 need only be attached to some structure that is fixed in relation to the movement of the platform 105. Thus, while the attachment point 125 is illustrated as being fixed to a separate structure from the platform 105 and associated man-lift, in various embodiments, the attachment point may be fixed to a support structure of the platform 105 that does not raise and lower, to other portions of the man-lift, and so on. Moreover, in one embodiment, the connecting member may be routed through a series of pulleys or other guides such that the attachment point is below a level of the safety gate 100.

With either implementation, it should be appreciated that the safety gate 100 functions to self-extend and self-retract according to a height 135 above the floor 110. Thus, initially, when the platform 105 is resting on or just above the floor 110, the safety gate 100 is in a retracted position such that the opening 120 is not obstructed. Accordingly, when in this position of not being raised above the floor to a significant degree, the connecting member is tightened and applying a force that pulls the safety gate into a retracted position. However, as the platform 105 is raised above the floor 110, the safety gate 100 extends into the opening 120 such that the opening 120 is obstructed by the safety gate 100. In one embodiment, this self-extension of the safety gate 100 occurs because a distance between the safety gate 100 and the attachment point 125 of the connecting member decreases, thereby decreasing a force exerted on the safety gate 100, at least temporarily, and permitting the safety gate to extend into the opening 120 according to an opposing force from an internal mechanism (e.g., spring, pneumatic cylinder, hydraulic cylinder, etc.). Consequently, as the height 135 increases, the safety gate 100 gradually extends to block the opening 120.

As a further matter, an amount of travel and a rate of travel for the safety gate 100 is, in one embodiment, directly proportional to the height 135. That is, because of the manner in which the connecting member is routed, the safety gate 100 gradually extends into the opening 120 proportional to the height 135. Thus, once the platform reaches a height that is equal to an amount of travel provided for in the gate 100 within the opening 120, the gate is fully extended and does not extend further as the platform continues to rise above the floor 110. Similarly, as the platform 105 lowers toward the floor 110, in one embodiment, the platform 105 reaches a height where the connecting member once again is under tension and begins to retract the safety gate 100 according to the height 135.

Figure 2:
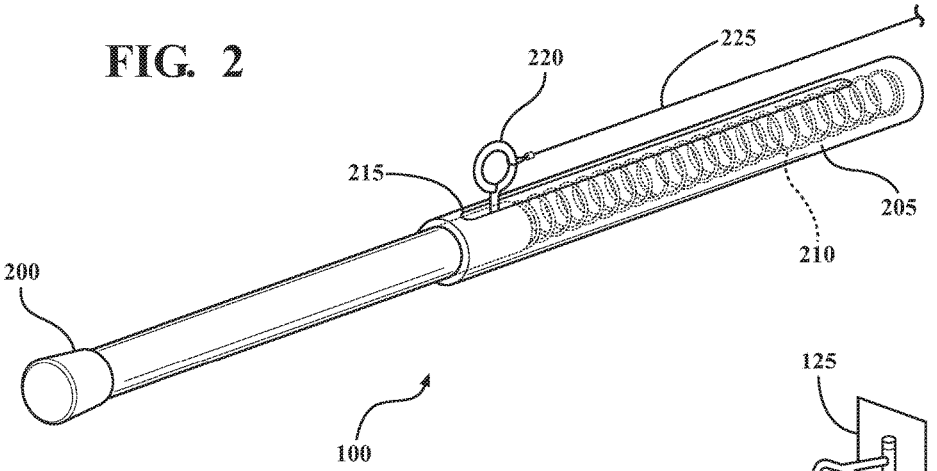
FIG. 2 illustrates one embodiment of a gate housing and a sliding member with an external connecting member.
Figure 2:
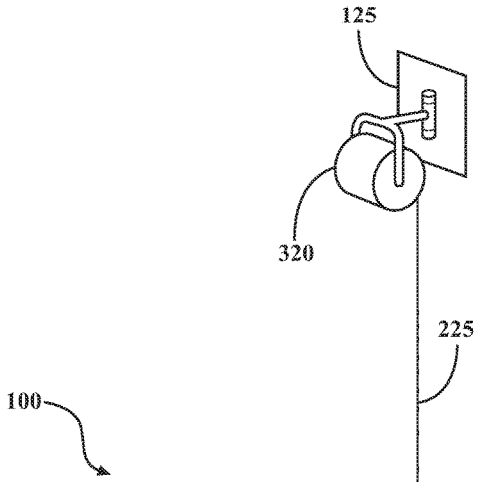

Further explanation of the safety gate 100 will be provided in relation to FIG. 2. FIG. 2 illustrates one embodiment of the safety gate 100 of FIG. 1. Accordingly, as illustrated, the safety gate 100 includes a sliding member 200 that is a moving/traveling component of the safety gate 100. That is, the sliding member 200 moves into and out of a housing 205. In one embodiment, the housing 205 is hollow and of a shape such that the sliding member 200 can substantially retract into the housing 205. Accordingly, the sliding member 200 and the housing 205 may both be cylindrical in shape, rectangular, triangular, and so on. In further embodiments, the housing 205 and the sliding member 200 may have differing shapes so long as the sliding member 200 can retract into the housing 205. Thus, in one embodiment, the sliding member 200 can retract into the housing 205 such that none of the sliding member 200 extends beyond the housing 205. In another embodiment, an end portion of the sliding member 200 with a cap or other protrusion may extend beyond an opening of the housing 205 when the sliding member 200 is retracted.

Moreover, the housing 205 of FIG. 2 is pictured with an internal spring 210. The internal spring 210 is fixed to a rear portion of the sliding member 200 and provides an outward force in an extending direction onto the sliding member 200 when the sliding member is retracted into the housing 205. For example, a slot 215 within a side of the housing 205 provides for connecting an attachment point 220 to the sliding member 200. The attachment point 220 is coupled with a connecting member 225. In one embodiment, the connecting member 225 is a cable or other device that provides a rearward tension force onto the attachment point 220 and thus also the sliding member 200. As such, when the connecting member 225 is under tensioning force from, for example, the platform 105 being lowered to the floor 110, the sliding member 200 compresses the spring 210 within the housing. In this way, the sliding member 200 is self-retracting according to a tension from the connecting member 225.

Additionally, stored energy within the spring 210, when the sliding member 200 is in the retracted position, provides for extending the sliding member 200 from the housing 205 when the tensioning force within the connecting member 225 is relaxed. For example, as the platform 105 of FIG. 1 is raised from the floor 110, tension within the connecting member 225 is relaxed since a distance between the attachment point 220 and the attachment point 125 decreases. This action provides for the spring 210 pushing the sliding member 200 from the housing 205 according to an extent to which the tension is relaxed. In either case, the attachment point 220 slides within the slot 215 in concert with the sliding member 200. Moreover, the slot 215 can act as a stop for the sliding member 200 so that the sliding member is not pushed from the housing 205 by the spring 210. It should be appreciated that, in general, the movement of the sliding member 200 occurs according to an imbalance in forces between an extending force produced by the spring 210 or other extending mechanism and a retracting force produced by tension in the connecting member 225 or other retracting mechanism.

Figure 3:
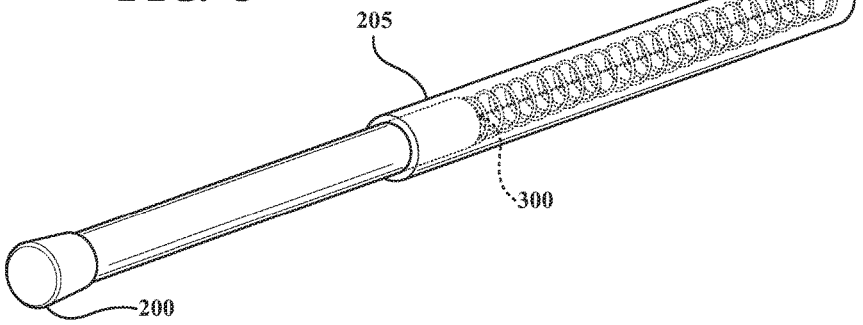
FIG. 3 illustrates another embodiment of a gate housing and a sliding member with an internal connecting member.

Alternatively, as illustrated in FIG. 3, the connecting member 225 can be attached through a rear of the housing 205 to a rear attachment point 300 of the sliding member 200. In this particular embodiment, the slot 215 with the attachment point 220 therein is replaced by the attachment point 300 and an opening at the rear of the housing 205 through which the connecting member 225 passes. In this way, additional pinch points that may cause injury to workers/operators of associated lifts are removed from the safety gate 100 to improve overall safety. Also, illustrated in FIG. 3 is a guiding member 310 and a pulley 320. The guiding member 310 is attached to a railing 115 or other structure (e.g., back support) at a rear of the housing 205. The guiding member 310 can be a pulley, or other device that minimizes friction between the connecting member 225 and guiding member 310 while also providing support to the connecting member 225. Additionally, the pulley 320 is in one embodiment, a tensioning pulley or take-up reel that includes a spring or other device which causes the pulley 320 to maintain a force on the connecting member 225 that is sufficient to uptake or otherwise reel-in slack of the connecting member 225 when the connecting member 225 is not under a load such as when the platform 105 is raised from the floor 110. In either case, the pulley 320 is part of the attachment point 125.

Furthermore, in one embodiment, the spring 210, the connecting member 225, the guiding member 310, and the attachment point 125 comprise a gate movement assembly of the safety gate 100 that causes the sliding member to extend and retract according to a height 135 of the platform 105.

Figure 4:
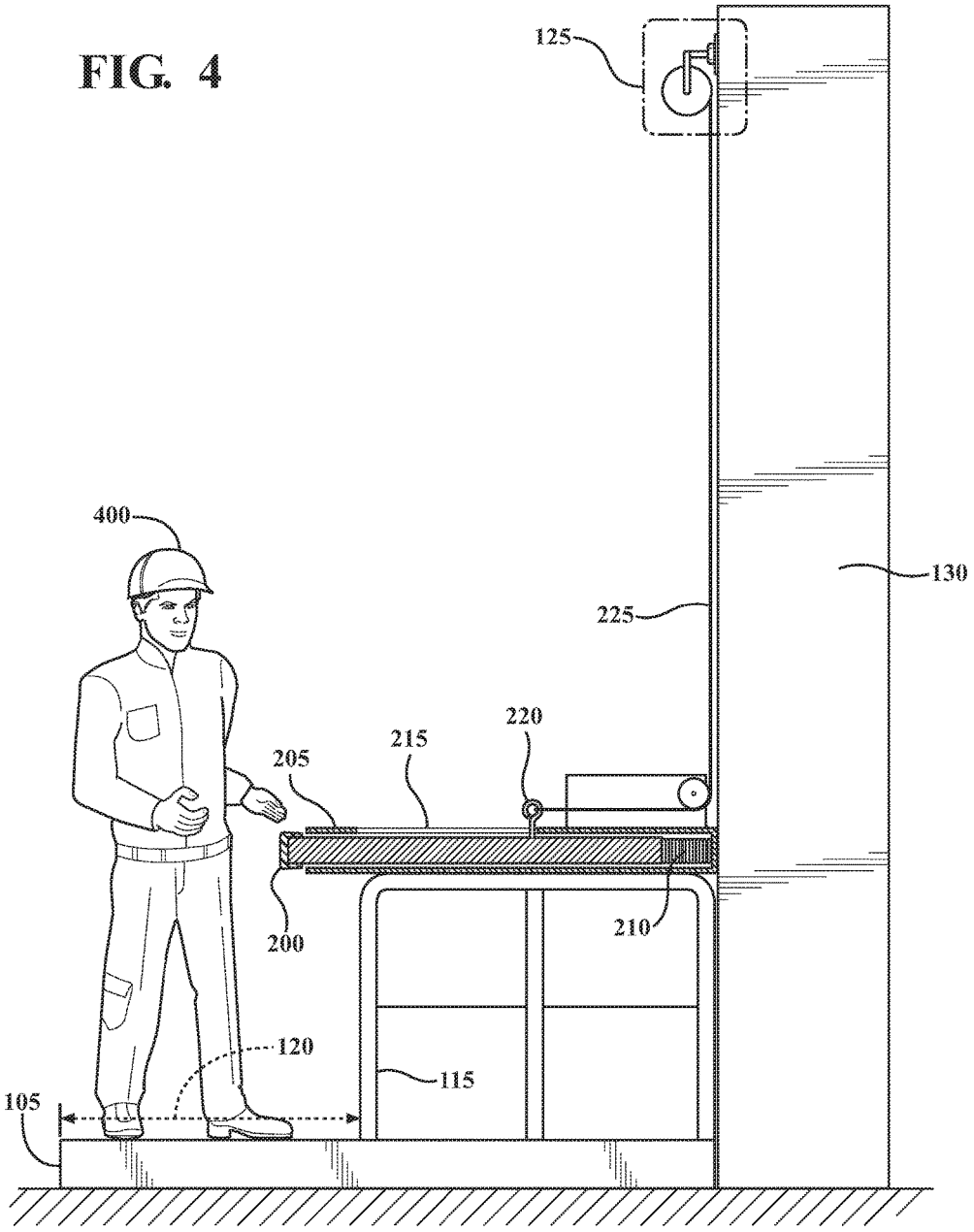
FIG. 4 is a side-view of one embodiment of a platform with a safety gate in a retracted position.
Figure 5:
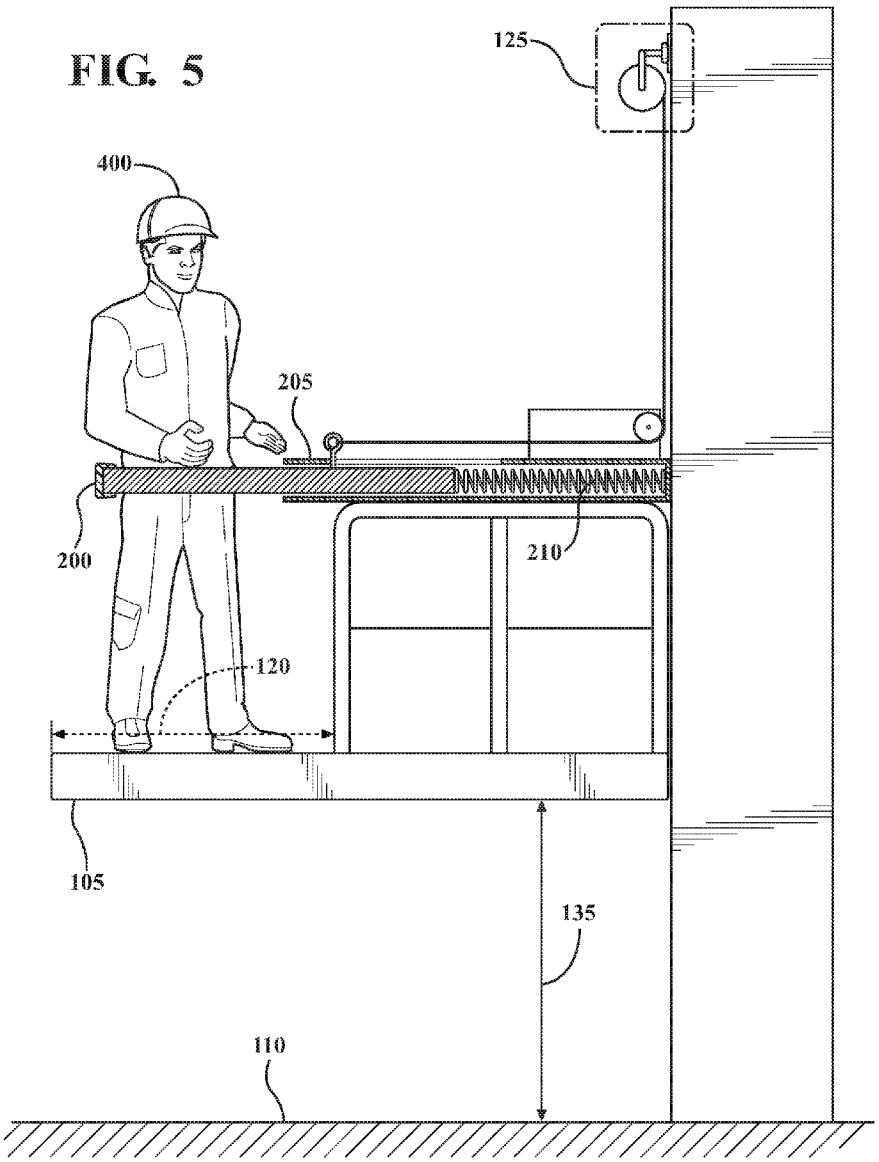
FIG. 5 is another side-view of one embodiment of a platform with a safety gate that is extended.

A further example of how the safety gate 100 operates is shown in FIG. 4 and FIG. 5. As an initial note, FIGS. 4 and 5, generally illustrate the housing 205 as being partially cutaway. As illustrated in FIG. 4, the spring 210 is compressed under a force provided via the connecting member 225 since the connecting member 225 is fully extended. Thus, a person 400 can ingress and egress through the opening 120 while the sliding member 200 is retracted. However, in FIG. 5, the spring 210 is at least less compressed than in FIG. 4 and thus has exerted a force on the sliding member 200 to extend the sliding member 200 from the housing 205 in order to block the person 400 from falling from the platform 105.

Figure 6:
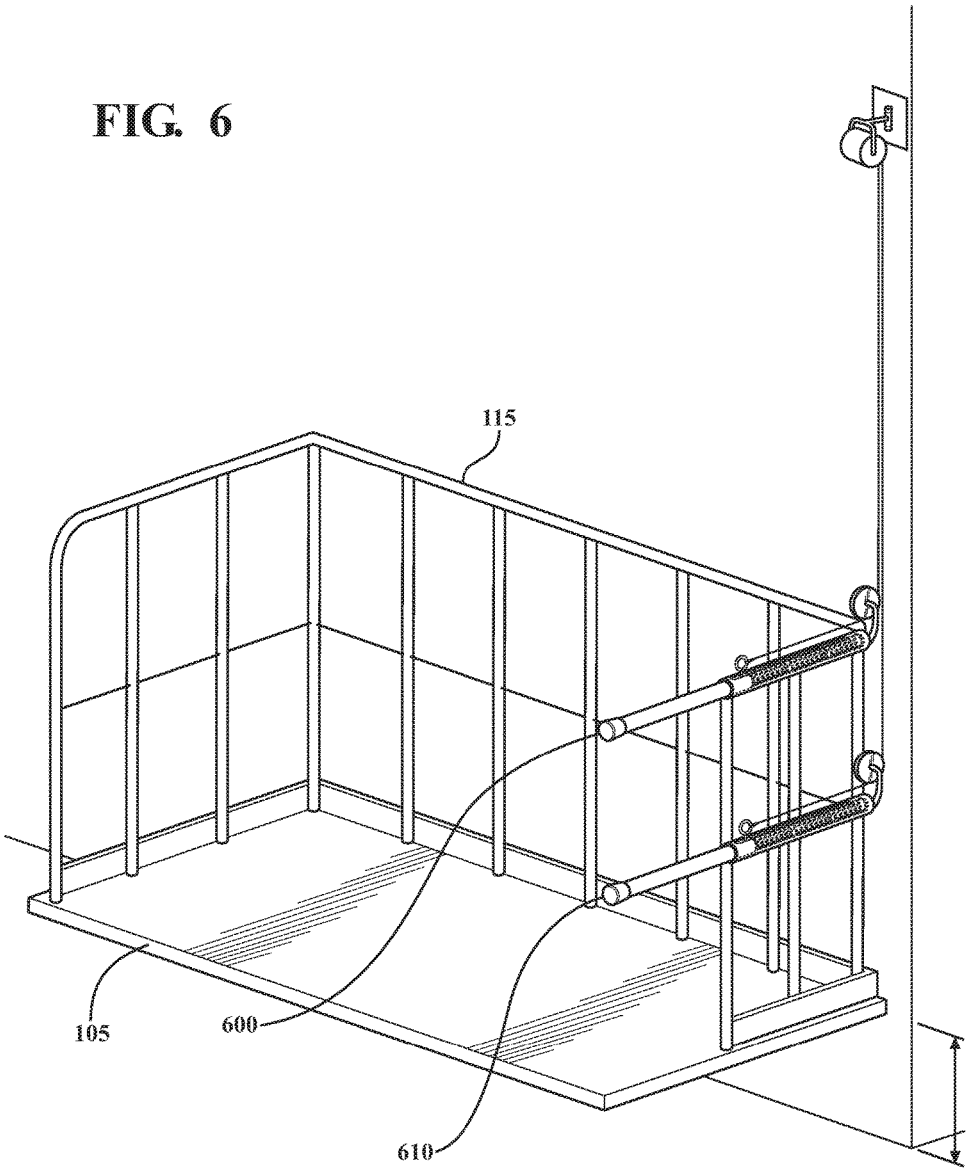
FIG. 6 illustrates an isometric view of one embodiment of a platform with a double safety gate.
Figure 7:
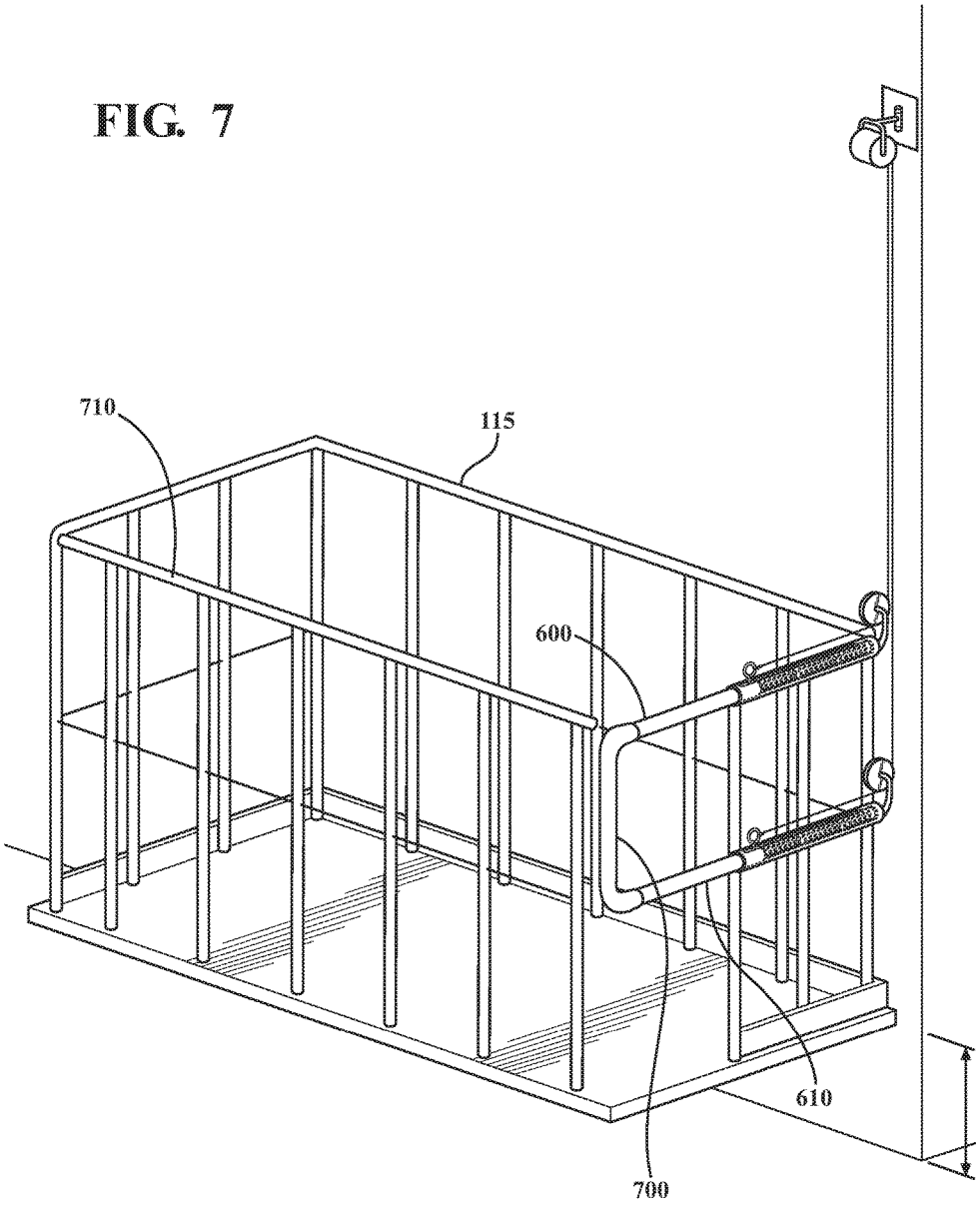
FIG. 7 illustrates an isometric view of one embodiment of a dual-member safety gate with vertical attaching member.

FIG. 6 illustrates a further embodiment of a safety gate as contemplated by this disclosure. As shown in FIG. 6, the platform 105 is equipped with an upper gate 600 and a lower gate 610. Each of the gates 600 and 610 are generally similar to the gate 100 as previously described. Additionally, a further embodiment is illustrated in FIG. 7 where the gates 600 and 610 are connected via a vertical cross member 700. Moreover, as shown in FIG. 7, the platform includes railings 710 in addition to railings 115 so that a whole perimeter of the platform 105 is guarded from fall hazards. Thus, the railings 115 and 710, in one embodiment, form a passenger compartment, or, part of a passenger compartment, of a manlift.

Figure 8:
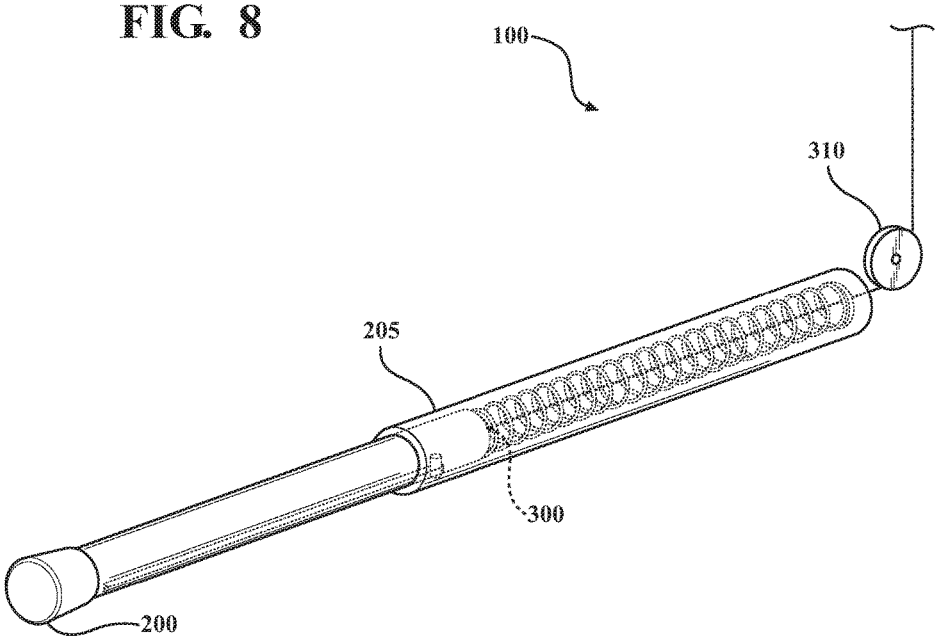
FIG. 8 illustrates another embodiment of a gate housing and a sliding member with an integrated hard stop.

FIG. 8 illustrates one embodiment of a safety gate that is similar to the safety gate illustrated in FIG. 3. However, as illustrated in FIG. 8, the safety gate includes a hard stop attached to a bottom of the housing 205. The hard stop extends into a groove within an underside of the sliding member 200. Thus, the hard stop acts to retain the sliding member 200 within the housing 205 should the connecting member 225 snap or otherwise become disconnected.

Detailed embodiments are disclosed herein; however, it is to be understood that the disclosed embodiments are intended only as examples. Therefore, specific structural and functional details disclosed herein are not to be interpreted as limiting, but merely as a basis for the claims and as a representative basis for teaching one skilled in the art to employ the various aspects herein in different arrangements to achieve the noted functionality. Further, the terms and phrases used herein are not intended to be limiting but rather to provide an exemplary explanation of possible implementations. Various embodiments are shown in FIGS. 1-7, but the embodiments are not limited to the illustrated structure or application.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details.

It will be understood by one having ordinary skill in the art that construction of the described invention and other components are not limited to any specific material. Other exemplary embodiments of the invention disclosed herein may be formed from a wide variety of materials, unless described otherwise herein. For example, the housing 205, the sliding member 200 and other components can be formed from various metal and/or metal alloys of steel, aluminum, and so on. In further examples, the components can be formed from rigid plastics, polymers or similar rigid materials.

As used herein, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e. open language). The phrase "at least one of . . . and . . . " as used herein refers to and encompasses any and all possible combinations of one or more of the associated listed items. As an example, the phrase "at least one of A, B, and C" includes A only, B only, C only, or any combination thereof (e.g. AB, AC, BC or ABC).

Aspects herein can be embodied in other forms without departing from the spirit or essential attributes thereof. Accordingly, reference should be made to the following claims, rather than to the foregoing specification, as indicating the scope hereof.

What is claimed is:

1. A safety gate for preventing falls from a platform, comprising:

a housing that extends laterally from a back support attached to the platform, wherein the housing is hollow;

a sliding member that is operable to (i) retract at least partially into the to back support to substantially conceal the sliding member within the housing and provide an opening beyond the housing for users to access the platform and to (ii) extend from an opening of the housing away from the back support to block access to the platform through the opening beyond the housing; and a gate movement assembly included at least partially within the housing between a rear portion of the sliding member and the back support, wherein the gate movement assembly is operable to cause the sliding member to extend and retract from the housing in relation to a change of height of the platform above a surface, without rotating the housing across the opening beyond the housing, and wherein the housing is statically mounted to the back support.

2. The safety gate of claim 1, wherein the gate movement assembly includes a spring.

3. The safety gate of claim 2, wherein the spring causes the sliding member to extend from the housing as the platform is raised from the surface.

4. The safety gate of claim 2, wherein the sliding member compresses the spring when sliding member is retracted into the housing.

5. The safety gate of claim 2, wherein the gate movement assembly further includes a connecting member having a first end and a second end, the first end being attached to the sliding member and the second end being attached to an attachment point, wherein the connecting member exerts a retracting force on the spring by pulling the sliding member toward the back support when the platform is lowered to the surface, and wherein the retracting force exerted by the connecting member is decreased as the platform is raised above the surface thereby permitting an extending force exerted by the spring to overcome the retracting force and extend the sliding member from the housing.

6. The safety gate of claim 5, wherein the connecting member is a cable, and wherein the first end of the connecting member is attached to the sliding member within the housing.

7. The safety gate of claim 5, wherein the attachment point is a pulley tensioner that maintains tension in the connecting member as the platform is raised from the surface thereby decreasing a distance between the first end and the second end.

8. The safety gate of claim 5, wherein the gate movement assembly further includes a guiding member at a rear of the housing that guides the connecting member toward the attachment point.

9. The safety gate of claim 1, wherein the housing includes a first bearing stop substantially near the opening of the housing and the sliding member includes a second bearing stop substantially near an end closest to the back support, and wherein the first bearing stop and the second bearing stop prevent the sliding member from exiting the housing when extended from the housing by the gate movement assembly.

10. The safety gate of claim 1, wherein the housing, and the sliding member are comprised of one or more of: a rigid metal, and a rigid polymer, wherein the sliding member travels within the housing and from the opening of the housing a distance that is substantially equal to a width of the opening beyond the housing.

11. The safety gate of claim 1, wherein the back support is part of a railing that substantially extends around a perimeter of the platform, and wherein the safety gate, the platform, and the railing at least partially form a passenger compartment of a manlift.

12. A gate connected to a platform, comprising:

a housing that extends laterally from a back support attached to the platform, wherein the housing is hollow;

a sliding member that is operable to (i) retract at least partially into the housing toward the back support to substantially conceal the sliding member within the housing and provide an opening beyond the housing for users to access the platform and to (ii) extend from an opening of the housing away from the back support to block access to the platform through the opening beyond the housing; and a gate movement assembly included at least partially within the housing between a rear portion of the sliding member and the back support, wherein the gate movement assembly is operable to cause the sliding member to extend and retract from the housing in relation to a change of height of the platform above a surface, without rotating the housing across the opening beyond the housing, and wherein the housing is statically mounted to the back support wherein the gate movement assembly includes a connecting member having a first end and a second end, the first end being attached to the sliding member and the second end being attached to an attachment point, and wherein the connecting member exerts a retracting force on the sliding member toward the back support when the platform is lowered toward the surface, and wherein the retracting force exerted by the connecting member is decreased as the platform is raised above the surface thereby permitting an extending force exerted by the gate movement assembly to extend the sliding member from the housing.

13. The gate of claim 12, wherein the connecting member is a cable, and wherein the first end of the connecting member is attached to the sliding member within the housing.

14. The gate of claim 12, wherein the attachment point is a pulley tensioner that maintains tension in the connecting member as the platform is raised from the surface thereby decreasing a distance between the first end and the second end.

15. The gate of claim 12, wherein the gate movement assembly further includes a guiding member at a rear of the housing that guides the connecting member toward the attachment point.

16. The gate of claim 12, wherein the gate movement assembly includes a spring that produces the extending force.

17. The gate of claim 16, wherein the spring causes the sliding member to extend from the housing as the platform is raised from the surface, and wherein the sliding member compresses the spring when the sliding member is retracted into the housing.

18. The gate of claim 12, wherein the gate movement assembly includes a spring that applies a force to the sliding member to extend the sliding member from the housing as the platform raises from the surface.

19. The gate of claim 12, wherein the back support is part of a railing that substantially extends around a perimeter of the platform, and wherein the gate, the platform, and the railing at least partially form a passenger compartment of a manlift.

20. A manlift, comprising:

a platform with railings connected thereto on at least three sides of the platform, the railings extending perpendicular from the platform to a railing height;

a gate to selectively obstruct a side opening in the railings when the platform is raised above a floor surface and to retract to provide access through the side opening when the platform is lowered onto the floor surface, the gate comprising:

a housing that extends laterally from a back support attached to at least one of the railings, wherein the housing is hollow;

a sliding member that is operable to retract at least partially into the housing toward the back support to substantially conceal the sliding member within the housing and to extend from the housing away from the back support to block access to the side opening of the platform while the housing supports the sliding member; and a gate movement assembly included at least partially within the housing between a rear portion of the sliding member and the back support, wherein the gate movement assembly is operable to cause the sliding member to extend and retract from the housing in relation to a change of height of the platform above the floor surface, without rotating the housing across the opening beyond the housing, and wherein the housing is statically mounted to the back support.

* * * * *